United States Patent [19]

Ritter

[11] 3,965,233

[45] June 22, 1976

[54] METHOD OF FORMING MOULDED ARTICLES

[76] Inventor: Paul Ritter, 76 Brookton Highway, Kelmscott, Australia

[22] Filed: Apr. 14, 1975

[21] Appl. No.: 567,998

Related U.S. Application Data

[63] Continuation-in-part of Ser. No. 382,525, July 25, 1973, abandoned.

[52] U.S. Cl. ..... 264/219; 264/129; 264/245; 264/293; 264/317; 264/321; 264/333; 264/337; 264/338; 427/133; 427/336

[51] Int. Cl.[2] ..... B28B 11/04

[58] Field of Search ..... 264/129, 219, 293, 317, 264/321, 337, 333, 245, 338; 427/133, 226, 336

[56] References Cited

UNITED STATES PATENTS 3,506,749 4/1970 Weissman ..... 264/321

FOREIGN PATENTS OR APPLICATIONS 2,002,505 8/1971 Germany ..... 264/317

*Primary Examiner*—Willard E. Hoag
*Attorney, Agent, or Firm*—Ulle C. Linton

[57] ABSTRACT

A method of producing a moulded article from concrete or the like comprising; having at least a portion of a mould formed of expanded polystyrene; treating the moulding face of the expanded polystyrene to form a textured and/or patterned surface; applying a colored composition to the moulding face of the expanded polystyrene; filling the mould with concrete or the like; upon the solidification of the concrete or the like, applying an organic solvent to the expanded polystyrene, wherein a portion of the solution of the solvent and polystyrene is caused to remain on the moulded article, the amount of solution remaining upon the moulded article being controlled by the amount of solvent applied to the expanded polystyrene; permitting the solvent to evaporate from the solution remaining on the moulded article to form a colored glazed finish upon the moulded product.

10 Claims, 2 Drawing Figures

METHOD OF FORMING MOULDED ARTICLES

This application is a continuation-in-part of application Ser. No. 382,525, filed July 25, 1973 and now abandoned.

This invention relates to a method of forming moulded articles of concrete or the like.

The term concrete or the like shall be taken to include materials such as concrete, cement, plaster of paris or the like material which will harden permanently from a plastic-like state over a relatively short period of time.

In one form the invention resides in a method of producing a moulded article from concrete or the like comprising; having at least a portion of a mould formed of expanded polystyrene, treating the moulding face of the expanded polystyrene to form a textured and/or patterned surface; applying a coloured composition to the moulding face of the expanded polystyrene, filling the mould with concrete or the like; upon the solidification of the concrete, applying an organic solvent to the expanded polystyrene to dissolve the polystyrene, wherein a portion of the solution of the solvent and polystyrene is caused to remain on the moulded article, the amount of solution remaining upon the moulded article being controlled by the amount of solvent applied to the expanded polystyrene, permitting the solvent to evaporate from the solution remaining on the moulding product to form a coloured glazed finish upon the moulded product.

The invention presents a significant advance over previous methods of forming moulded articles of concrete or the like. Previous methods have involved the use of bulky, heavy and expensive moulds. In addition the form of the moulds are fixed such that if it is desired to alter the form or pattern of the moulded article it is necessary to produce a further heavy mould. Therefore such previous methods were awkward, expensive and inflexible.

As a result of this invention the moulds used are inexpensive in regard to their basic material and may be readily formed to the shape and texture required of the moulded article. In addition the moulds lend themselves to flexibility in production since the moulds are produced on a one-to-one basis with respect to the moulded articles to be produced. The removal of the mould from the moulded article by application of a solvent reduces the danger of damaging the product at a stage during which damage is an ever present problem of previous moulding processes.

It is envisaged that the invention may be used to produce moulded articles such as flower pots, lamp bases, vases, decorative sculptured articles and panels. The invention may also be used in the construction of more massive structures such as buildings, bridges tunnels or the like where it is desired that the exposed surface of the structure has a decorative coloured finish.

Figure 1:
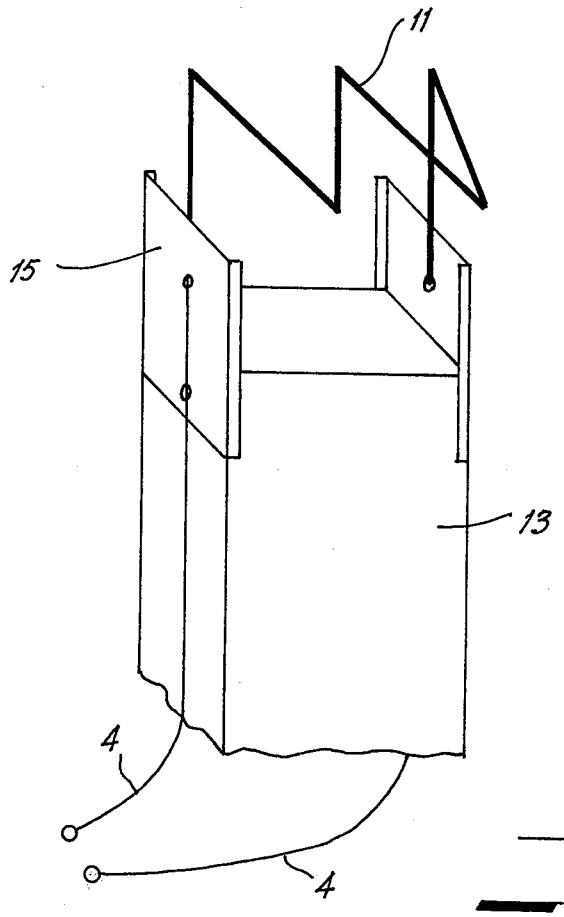
Figure 2:
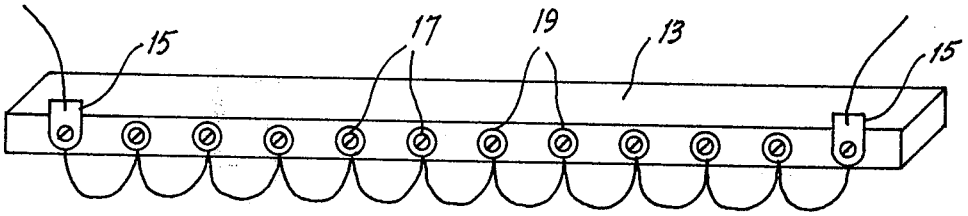

The invention will be more fully understood in the light of the following description of several specific embodiments. The description is made with reference to the accompanying drawings of which:

FIG. 1 is a perspective view of one form of an electric cutting tool which may be used in the forming of the mould; and FIG. 2 is a perspective view of another form of an electric cutting tool which may be used in the forming of the mould.

One embodiment of the invention resides in the production of decorative concrete panels for the mounting to the facades of buildings. The mould for such panels comprises a base sheet of expanded polystyrene and a border around the edges to the desired thickness of the final product. The mould may be formed completely of expanded polystyrene, or may only have a base of expanded polystyrene, or may be in the form of a tray of a non-destructible nature into the base of which a sheet of expanded polystyrene foam may be inserted.

Before installation in the mould the moulding face of the base sheet is treated to provide a patterned or textured moulding face. The method of treatment may comprise the spraying onto the moulding face a small quantity of an organic solvent which will dissolve the expanded polystyrene (eg. toluol or petrol). The amound sprayed should only be enough to affect the surface of the expanded polystyrene sheet. By the use of the spraying method together with a masking of the moulding face a large variety of patterns may be produced.

Another method of treatment of the moulding face is by means of electrically heated printing tools. Basically the printing tools (as seen in FIGS. 1 or 2) comprise an element 11 shaped to produce a particular pattern upon the expanded polystyrene sheet. The element is fixed to a support frame and/or handle 13 by a heat sink 15. The element is connected at either end to a source of electricity the flow of which through the element will heat the element. The tool may take the form as shown in FIG. 1 wherein the element is shaped to form a geometric shaped impression in the moulding face. The shape of the element may be singular like the form shown in FIG. 1 or may comprise a multiplicity of shapes to produce a composite pattern.

The printing tool as seen in FIG. 2 represents a tool of a shearing form wherein the element 11 is drawn longitudinally through the moulding face to produce a grooved pattern on the moulding face. The tool has a support frame 13 and a heat sink at each end thereof which are to be connected to a source of electricity. An element 11 is mounted between the heat sinks and may be of any desired shape such that when drawn through the expanded polystyrene sheeting the element will cut grooves into the sheeting of the desired shape. The tool shown in FIG. 2 comprises a series of substantially U-shaped loops wherein the termination of each loop is fixed to the support frame by a screw 17 and washers 19. The screw and washers serve not only to attach the element to the support frame but also act as heat sinks. In use the tools of the form similar to that shown in FIG. 2 may be drawn through the sheet along a straight line, or pivotted about a fixed point either on the sheet or outside the sheet. The support frame may also be fixed to a base in order that the sheet is pushed past the element.

The purpose of the heat sinks is to remove excess heat from the non-working portions of the element and so prevent burning out of the element.

Once the moulding face of the base sheet has been treated to provide a patterned or textured surface a colouring composition is applied to the moulding face. The application of the colouring composition may be by any known method however it is necessary that the composition contain very little or no substance which will affect the surface of the expanded polystyrene. The colouring composition may comprise spraying paint having organic solvents in it which is sprayed onto the moulding face with a very light spray such that most of the solvent has evaporated from the paint before it contacts the surface of the expanded polystyrene. Another method of application comprises mixing an adhesive used with expanded polystyrene with a dye or tinting composition and applying the mixture to the moulding face. An example of the adhesive that may be used is manufactured by 3M Australia Pty. Ltd. under the code EC2296.

Once the moulding face of the base sheet of the mould has been textured and coloured in the manner desired the mould is put together and is filled with concrete or the like material which is then allowed to set. The polystyrene portion of the mould is partially removed from the formed article by the application of an organic solvent or the like which will dissolve the expanded polystyrene. The application of the solvent transforms the expanded polystyrene into a solution form. The amount of solvent applied to the moulded article is governed by the amount of polystyrene solution it is desired to retain upon the article and so the desired finish required of the article. If the article is dipped into a bath of solvent only a small quantity of the resultant solution of polystyrene is retained upon the article and the resultant finish is a dull glase upon the coloured surface of the moulded article. Alternatively if only a small quantity of solvent is applied to the expanded polystyrene by a spraying or brushing technique most of the resultant solution of polystyrene retained upon the surface of the moulded article. Upon the evaporation of solvent the resultant finish upon the moulded article is highly glazed. The transformation of the expanded polystyrene by the action of the solvent also involves some intermixing with the colouring composition which becomes at least partially incorporated in the resultant solution of polystyrene. Such intermixing can produce some interesting effects on the surface of the moulded article.

A further method of removing the expanded polystyrene from the moulded article comprises saturating the polystyrene with an inflammable solvent and then igniting the solvent. The heat so produced melts the polystyrene and burns a portion of it away. However not all of the polystyrene is consumed and upon the article cooling the melted polystyrene solidifies to produce an attractive glaze.

The process of the invention may be applied to the production of three dimensional articles having a patterned surface such as flower pots, lamp bases sculptured decorative articles and the like. In such a case the inside of the mould is treated in the manner as decribed for the panels and the destruction of the mould is controlled by the amount of solvent to be applied to the mould.

An added advantage of this method of producing moulded articles is that, particularly in the case of panels, the destruction of the mould from the article can be after the article has been installed in position. Therefore the mould also serves in protecting the surface thereof during installation.

I claim:

1. A method of molding a coated article comprising: forming a mold from expanded polystyrene and reshaping a molding surface of said polystyrene to provide a configured surface; applying a coloured composition to a molding surface of said polystyrene; filling said mold with a settable hydraulic cement and allowing said cement to harden, applying an organic solvent to said mold to dissolve at least a portion of said polystyrene and said colored composition, causing a portion of said polystyrene, said composition and said solvent to remain on the concrete article, said colored composition being at least partially soluble in said solvent and permitting said solvent to evaporate to form a coloured glazed finish on the surface of said article.

2. The method of claim 1 wherein said reshaping includes applying solvent to said expanded polystyrene to dissolve a portion of the surface thereof.

3. The method of claim 1 wherein said reshaping comprises: applying a masking material to portions of the polystyrene and applying a small quantity of solvent to the polystyrene to dissolve the surface thereof not covered by the masking material.

4. The method of claim 1 wherein said reshaping comprises embossing said polystyrene by applying configured heating means to said polystyrene.

5. A method as claimed in claim 1 wherein the coloured composition is sprayed onto the moulding face.

6. A method as claimed in claim 1 wherein the method of applying the organic solvent to the mould comprises dipping the moulded article and mould into a container holding a quantity of the solvent.

7. A method as claimed in claim 1 wherein the method of applying the organic solvent to the mould comprises spraying the solvent onto the mould.

8. A method as claimed in claim 1 wherein the organic solvent is inflammable and after its application to the expanded polystyrene it is ignited to cause the polystyrene to melt, a portion of which is burnt away while a portion remains on the moulded article to solidify on cooling.

9. A method as claimed in claim 1 wherein the treatment of the moulding face comprises the application of an electrically heated element to imprint upon the moulding face a pattern or shape.

10. A method as claimed in claim 1 wherein the treatment of the moulding face comprises the drawing of an electrically heated element through the expanded polystyrene parallel to the plane thereof.

* * * * *